US008353570B2

(12) United States Patent
Ishikawa

(10) Patent No.: US 8,353,570 B2
(45) Date of Patent: Jan. 15, 2013

(54) LIQUID EJECTING APPARATUS AND LIQUID EJECTING METHOD

(75) Inventor: Hiroyuki Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 387 days.

(21) Appl. No.: 12/704,468

(22) Filed: Feb. 11, 2010

(65) Prior Publication Data

US 2010/0207981 A1 Aug. 19, 2010

(30) Foreign Application Priority Data

Feb. 13, 2009 (JP) ..... 2009-031732

(51) Int. Cl.
*B41J 29/38* (2006.01)

(52) U.S. Cl. ..... 347/14; 347/5

(58) Field of Classification Search ..... 347/14, 347/15, 5

See application file for complete search history.

(56) References Cited

U.S. PATENT DOCUMENTS

| | | | | |
|---|---|---|---|---|
| 6,802,584 | B2 | 10/2004 | Kageyama | |
| 2006/0209188 | A1 * | 9/2006 | Mizusawa | 348/148 |
| 2007/0040877 | A1 | 2/2007 | Kachi | |
| 2009/0284559 | A1 | 11/2009 | Sudo et al. | |

FOREIGN PATENT DOCUMENTS

| | | | | |
|---|---|---|---|---|
| JP | 06166247 A | * | 6/1994 | 347/15 |
| JP | 08-108532 | | 4/1996 | |
| JP | 2002-316423 | | 10/2002 | |
| JP | 2004-066550 | | 3/2004 | |
| JP | 2007-050565 | | 3/2007 | |
| JP | 2009-274280 | | 11/2009 | |

* cited by examiner

*Primary Examiner* — Laura Martin

(74) *Attorney, Agent, or Firm* — Workman Nydegger

(57) ABSTRACT

A liquid ejecting apparatus includes a liquid ejecting head that ejects liquid from a nozzle. A head movement section moves the liquid ejecting head in a movement direction. A controller controls a movement ejection operation that ejects the liquid from the nozzle while moving the liquid ejecting head in the movement direction. If there is satisfied a decision condition that indicates that the ejection rate is excessive, the controller causes the number movement ejection operations related to a certain range to be larger than if the decision condition were not satisfied. With respect to second liquid being higher in viscosity than first liquid, the controller determines the number movement ejection operations related to the above-mentioned certain range by the above-mentioned decision condition determined as excess of the above-mentioned ejection rate at an ejection rate being smaller than that of the first liquid.

8 Claims, 14 Drawing Sheets

| THRESHOLD VALUE | INK | | |
|---|---|---|---|
| | A | B | C |
| Th1 [%] | 50 | 55 | 65 |
| Th2 [%] | 25 | 27 | 33 |
| Pc | 8 | 8 | 8 |
| SUPPOSITION VISCOSITY | – | 5% REDUCTION | 13% REDUCTION |

| THRESHOLD VALUE | TEMPERATURE [°C] | | |
|---|---|---|---|
| | A | B | C |
| Th3 [%] | 25 | 27 | 31 |
| R1 | 40 | 40 | 40 |

LIQUID EJECTING APPARATUS AND LIQUID EJECTING METHOD

BACKGROUND

1. Technical Field

The present invention relates to a liquid ejecting apparatus and a liquid ejecting method.

2. Related Art

In a liquid ejecting apparatus such as an ink jet printer, there was a problem that in a case where the replenishment amount of liquid which is replenished from a liquid replenishment section is smaller than the ejection amount of liquid which is ejected from a nozzle, poor ejection of liquid occurs in the nozzle. With respect to such a problem, there has been proposed an apparatus which controls dot formation on the basis of a temperature of a liquid ejecting head (refers to JP-A-2004-66550).

However, in the prior apparatus, the relationship between time series change in the ejection amount in a case where liquid is continuously ejected from a nozzle and a replenishment property was not sufficiently studied.

SUMMARY

An advantage of some aspects of the invention is that it effectively suppresses poor ejection due to lack of replenishment of liquid in a case where liquid is continuously ejected from a nozzle.

According to a first aspect of the invention, there is provided a liquid ejecting apparatus including: a liquid ejecting head which has a plurality of successive flow paths reaching from a liquid replenishment section to a nozzle and ejects liquid from the nozzle; a head movement section which moves the liquid ejecting head in a movement direction; and a controller which controls a movement ejection operation that ejects the liquid from the nozzle while moving the liquid ejecting head in the movement direction, and, in the case of satisfying a decision condition representing that an ejection rate of liquid in a time series is excessive, makes the number of times of the movement ejection operation related to a certain range be larger than a case where the decision condition is not satisfied, wherein, with respect to second liquid being higher in viscosity than first liquid, the controller determines the number of times of the movement ejection operation related to the above-mentioned certain range by the above-mentioned decision condition determined as excess of the above-mentioned ejection rate at an ejection rate being smaller than that of the first liquid.

Other aspects of the invention will become apparent from the description of this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
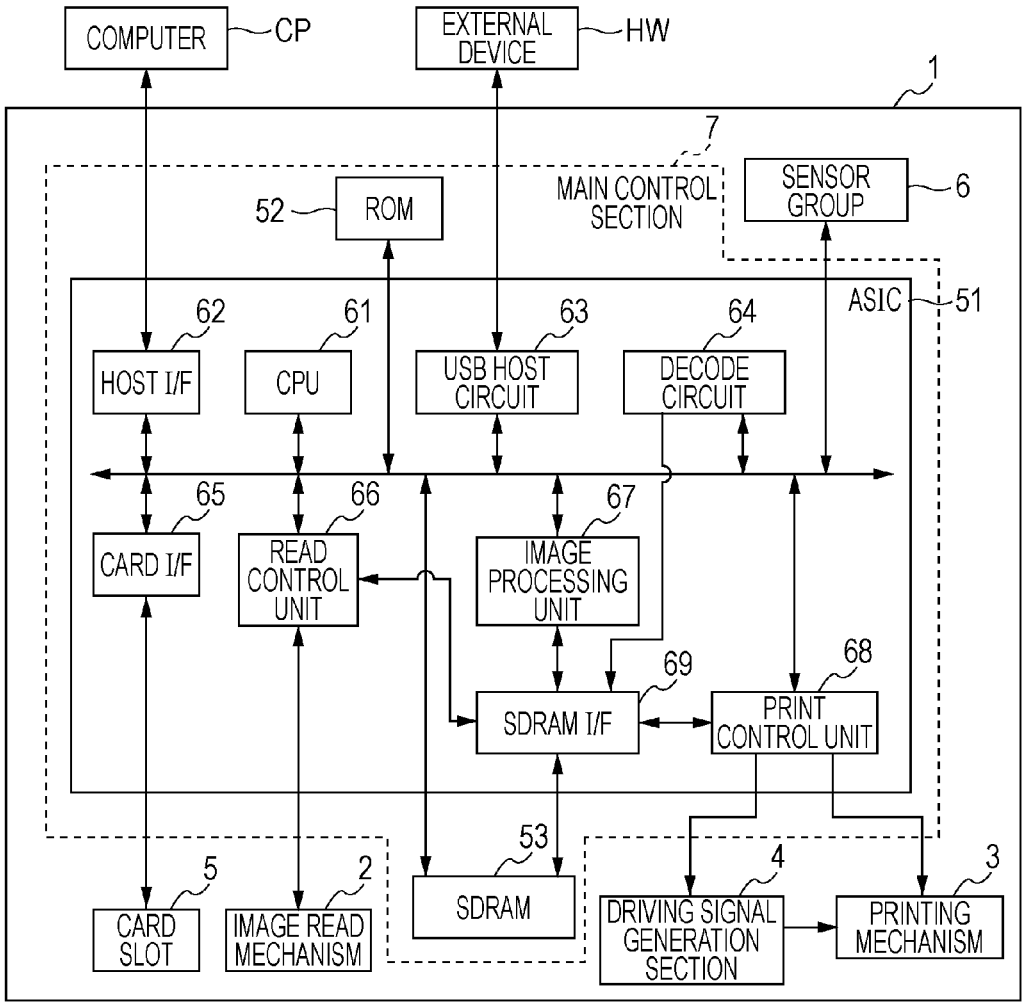
FIG. 1A is a block diagram explaining the configuration of a printing system.

At least the following aspects will become apparent from the description of this specification and the description of the accompanying drawings.

That is, it will become apparent that a liquid ejecting apparatus can be realized which includes: a liquid ejecting head which has a plurality of successive flow paths reaching from a liquid replenishment section to a nozzle and ejects liquid from the nozzle; a head movement section which moves the liquid ejecting head in a movement direction; and a controller which controls the movement ejection operation that ejects the liquid from the nozzle while moving the liquid ejecting head in the movement direction, and, in the case of satisfying a decision condition representing that an ejection rate of the liquid in the movement ejection operation is excessive, makes the number of times of the movement ejection operation related to a certain range be larger than a case where the decision condition is not satisfied, wherein, with respect to second liquid being higher in viscosity than first liquid, the controller determines the number of times of the movement ejection operation related to the above-mentioned certain range by the above-mentioned decision condition determined as excess of the above-mentioned ejection rate at an ejection rate being smaller than that of the first liquid.

According to this liquid ejecting apparatus, in a case where an ejection rate of a liquid in the movement ejection operation is excessive, since the number of times of the movement ejection operation related to a certain range is increased, lack of replenishment of the liquid due to the fact that the ejection rate is excessive can be suppressed. In addition, since the kind of liquid is taken into account in a decision of whether or not to increase the number of times of the movement ejection operation, lack of replenishment of liquid can be reliably suppressed.

In the liquid ejecting apparatus, it is preferable that the ejection rate of the liquid be proportional to the amount of liquid which is ejected at a certain timing and the largest amount of liquid which can be ejected at the above-mentioned certain timing.

According to this liquid ejecting apparatus, lack of replenishment of liquid can be reliably recognized.

In the liquid ejecting apparatus, it is preferable that the controller perform continuity evaluations in which in a case where ejection of the liquid at an ejection rate being equal to or more than a first ejection rate is performed the prescribed number of times within a range of a certain time series, it is evaluated as continuity existing; and replenishment property evaluation in which in a case wherein the continuity evaluation has been evaluated as continuity existing, and then, in a case where ejection of the liquid at an ejection rate being equal to or more than a second ejection rate is performed the prescribed number of times within a range of another time series subsequent to the above-mentioned certain time series, it is evaluated as having no replenishment property, whereby, in a case wherein the replenishment property evaluation has been evaluated as having no replenishment property, a decision is made that the decision condition is satisfied.

According to this liquid ejecting apparatus, since whether to satisfy a decision condition is decided by two kinds of evaluation, the degree of precision of the decision can be increased.

In the liquid ejecting apparatus, it is preferable that in the continuity evaluation, in a case where the ejection rate at certain timing is equal to or more than the first ejection rate, addition of an evaluation value be performed, on the other hand, in a case where the ejection rate at certain timing is equal to or less than a third ejection rate being lower than the first ejection rate, subtraction of an evaluation value be performed, and in a case where the evaluation value exceeds a decision value corresponding to the prescribed number of times, it be evaluated as continuity existing.

According to this liquid ejecting apparatus, since evaluation of continuity is performed on the basis of an evaluation value, the degree of precision of the evaluation can be increased.

In the liquid ejecting apparatus, it is preferable that the first ejection rate corresponding to the second liquid be smaller than the first ejection rate corresponding to the first liquid, and the second ejection rate corresponding to the second liquid be smaller than the second ejection rate corresponding to the first liquid.

According to this liquid ejecting apparatus, a decision by the kind of liquid can be reliably performed.

In the liquid ejecting apparatus, it is preferable that the liquid ejecting head have a nozzle row with a plurality of nozzles arranged in an intersecting direction intersecting with the movement direction, and the controller, in a case where the decision condition is satisfied, performs a prior movement ejection operation by using a portion of the nozzles belonging to the nozzle row and performs a posterior movement ejection operation by using another portion of the nozzles.

According to this liquid ejecting apparatus, the ejection amount of liquid can be easily restricted.

In the liquid ejecting apparatus, it is preferable that the controller perform the prior movement ejection operation by using the respective nozzles which are a portion of the nozzles belonging to the nozzle row and are located at one side half portion in the intersecting direction, and performs the posterior movement ejection operation by using remaining nozzles.

According to this liquid ejecting apparatus, since the ejected liquid and each nozzle correspond to each other, uniformity of the ejected liquid can be improved.

In the liquid ejecting apparatus, it is preferable that the liquid ejecting head have a certain nozzle group composed of a plurality of nozzles which ejects a certain kind of liquid, and another nozzle group composed of a plurality of nozzles which ejects another kind of liquid being different in viscosity from the above-mentioned certain kind of liquid, and the controller, in the case of satisfying the decision condition with respect to the above-mentioned certain kind of liquid, even if the above-mentioned another kind of liquid does not satisfy the decision condition, set, with respect to the above-mentioned another kind of liquid, the number of times of the movement ejection operation related to the above-mentioned certain range to be the same number of times as that of the above-mentioned certain liquid.

According to this liquid ejecting apparatus, trouble due to the fact that the number of times of dot formation operation varies for every kind of liquid can be effectively prevented.

In addition, it will also become apparent that the following liquid ejecting method can be realized.

That is, it will also become apparent that a liquid ejecting method that, by using a liquid ejecting head which has a plurality of successive flow paths reaching from a liquid replenishment section to a nozzle, replenishes liquid supplied from a liquid storage section and stored in a common liquid chamber, through by the liquid replenishment section and ejects liquid from a corresponding nozzle can be realized which the method includes: deciding whether or not to satisfy a decision condition representing that an ejection rate of the liquid in the movement ejection operation that ejects liquid from the nozzle while moving the liquid ejecting head in a movement direction is excessive, and also showing that, with respect to second liquid being higher in viscosity than first liquid, the ejection rate is excessive at an ejection rate being smaller than that in the first liquid; and in a case where the decision condition is not satisfied, in the movement ejection operation, making the number of times of the movement ejection operation related to a certain range be larger than a case where the decision condition is not satisfied.

First Embodiment

Concerning the Printing System

A printing system illustrated in FIG. 1A is for printing an image on a paper S (refers to FIG. 2, etc.) and includes a computer CP and a multifunction device 1. The multifunction device 1 is an apparatus which also acts as an ink jet printer, and is one kind of liquid ejecting apparatus which prints an image on a medium such as the paper S by ejecting ink (aqueous ink or oily ink) in the form of liquid. The computer CP carries out control for making the multifunction device 1 perform liquid ejection operation.

The multifunction device 1 has an image read mechanism 2, a printing mechanism 3, a driving signal generation section 4, a card slot 5, a sensor group 6, and a main control section 7. In the multifunction device 1, the controlled objects, that is, the image read mechanism 2, the printing mechanism 3, and the driving signal generation section 4 are controlled by the main control section 7 which serves as a controller.

Figure 2:
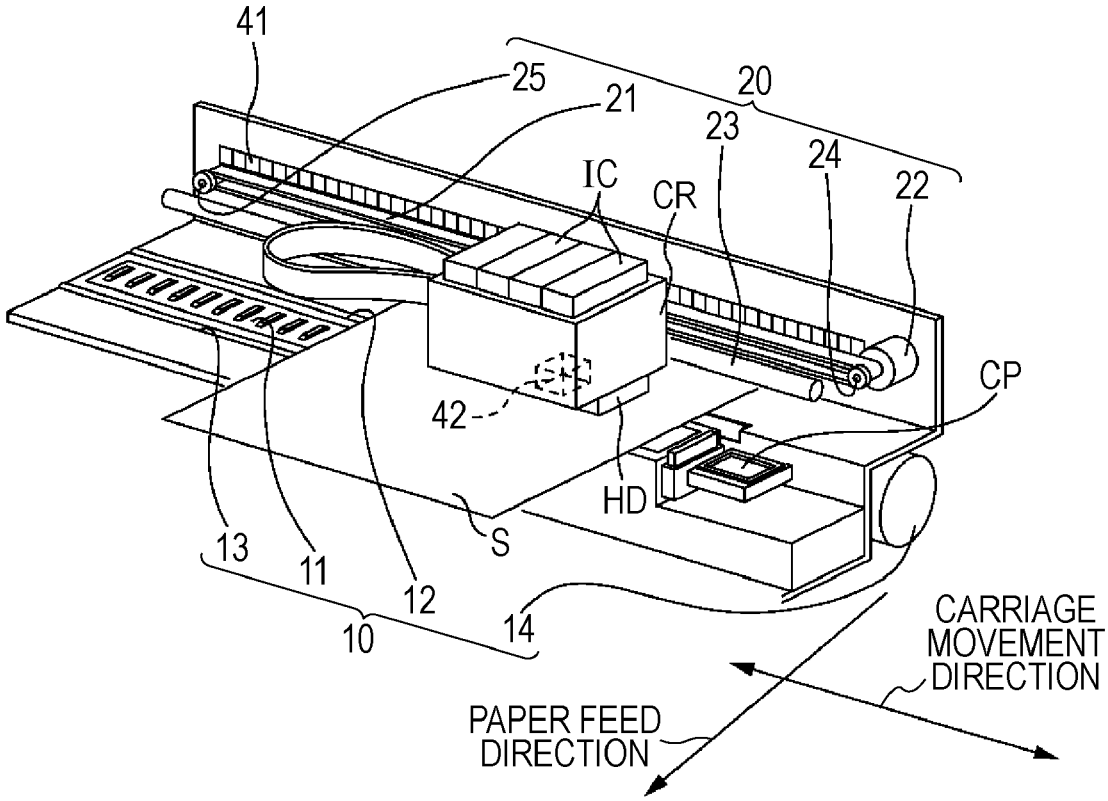
FIG. 2 is a perspective view explaining a printing mechanism.

The image read mechanism 2 is a section which acquires image data of multi-gradation by reading a manuscript. The image read mechanism acquires RGB image data expressed by 256 gradations with respect to each color of, for example, RGB. The printing mechanism 3 is a section which prints an image by ejecting ink onto the paper S as a medium and corresponds to a liquid ejecting mechanism. For example, as shown in FIG. 2, the printing mechanism 3 has a paper transport mechanism 10, a carriage CR, and a carriage movement mechanism 20. The paper transport mechanism 10 is for transporting the paper S in a paper feed direction and has a platen 11 which supports the paper S from a back face side, a transport roller 12 disposed on a further upstream side than the platen 11 in the paper feed direction, a paper discharge roller 13 disposed on a further downstream side than the platen 11 in the paper feed direction, and a transport motor 14 which is a driving source of the transport roller 12 or the paper discharge roller 13. The carriage CR is a member on which ink cartridges IC and a head HD are mounted. In a state where the head HD is mounted on the carriage CR, a nozzle formation face of the head faces the platen 11.

Figure 3:
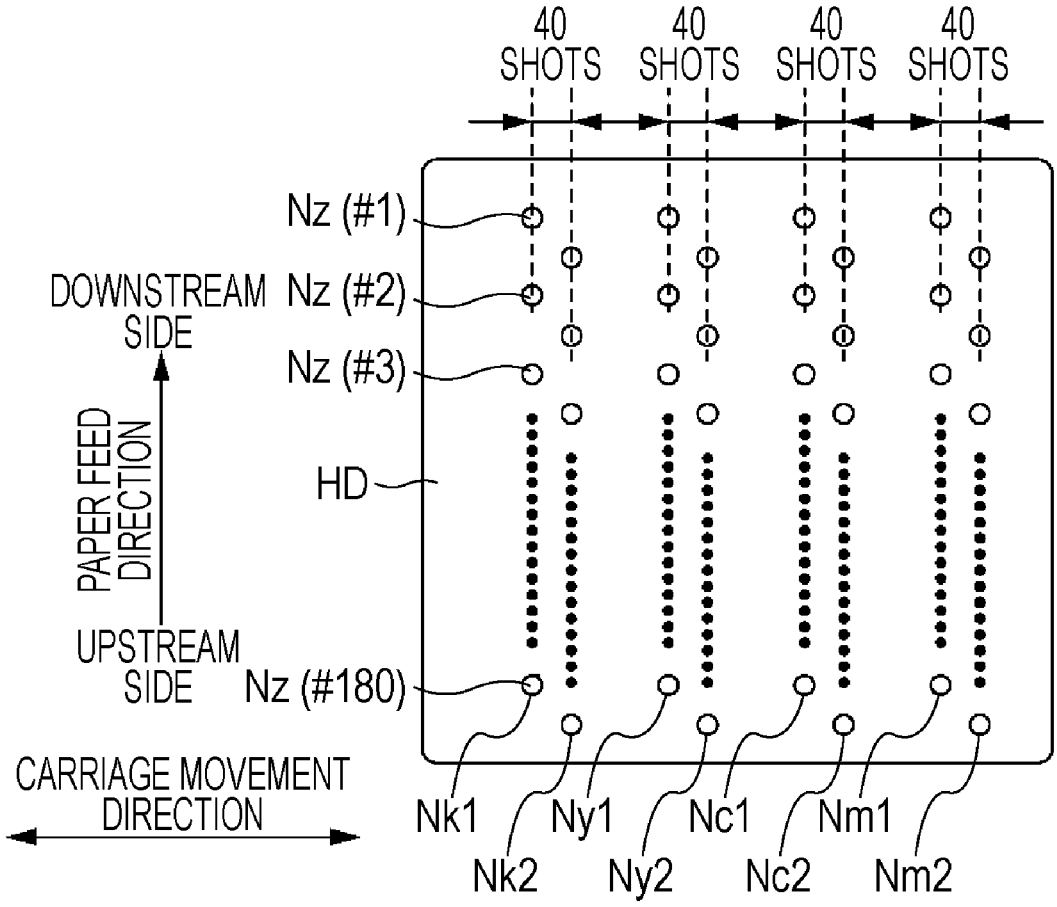
FIG. 3 is a view explaining nozzle rows.

As shown in FIG. 3, at the head HD, a plurality of nozzles Nz are provided. Then, a nozzle row is composed of a plurality of nozzles Nz arranged in the paper feed direction (corresponding to an intersecting direction intersecting with the carriage movement direction), and a plurality of nozzle rows are arranged in the carriage movement direction. Specifically, two nozzle rows are provided for one kind of ink. These nozzle rows are out of alignment by 40 shots (40 dots) in the carriage movement direction and by a half of a nozzle pitch in the paper feed direction. That is, the respective nozzles Nz belonging to these nozzle rows are disposed in a zigzag form. In this embodiment, one nozzle row is composed of 180 nozzles Nz and provided such that adjacent nozzles Nz have an interval equivalent to 180 dpi. Accordingly, printing equivalent to 360 dpi can be performed by using 1 set of nozzle rows. In the example of FIG. 3, in order from the left end, black ink nozzle rows Nk1 and Nk2 which eject black ink, yellow ink nozzle rows Ny1 and Ny2 which eject yellow ink, cyan ink nozzle rows Nc1 and Nc2 which eject cyan ink, and magenta ink nozzle rows Nm1 and Nm2 which eject magenta ink are provided. Accordingly, in this multifunction device 1, color printing is performed by 4 colors.

Figure 4A:
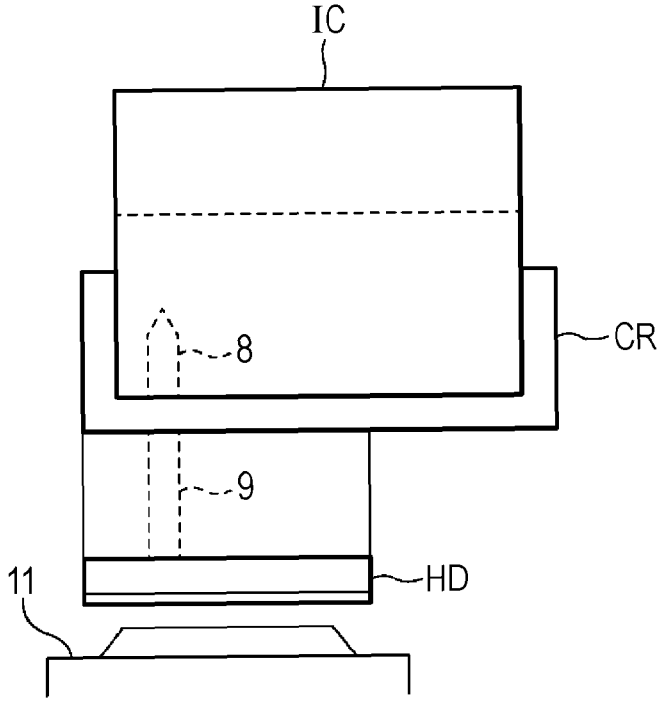
FIG. 4A is a view explaining an ink flow path from an ink cartridge to a head.
Figure 4B:
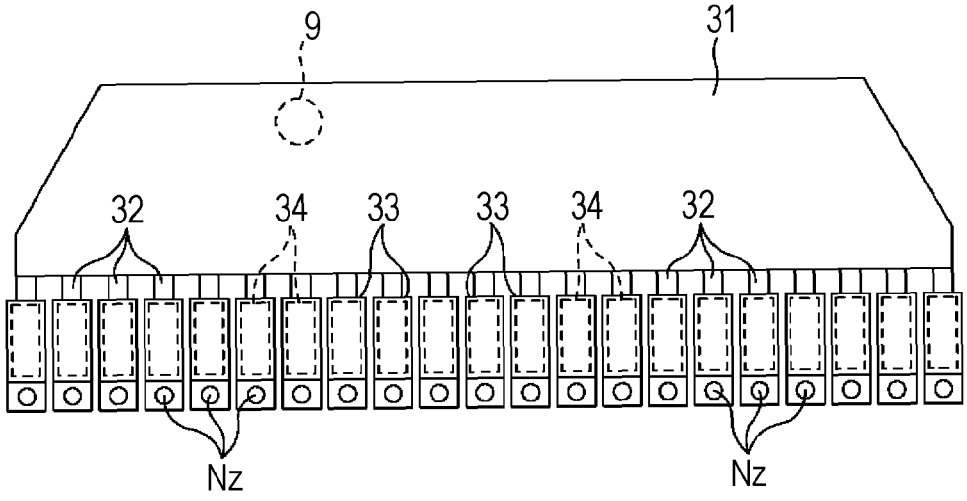
FIG. 4B is a view explaining the flow paths in the head.

As shown in FIGS. 4A and 4B, the ink in the ink cartridge IC disposed above the head HD is supplied to the head HD. That is, in the ink cartridges IC, ink of different colors (different kinds of liquid) are individually stored. Then, the ink in the ink cartridge IC is supplied to the head HD through a ink supply needle 8 inserted into the bottom portion of the ink cartridges IC and an ink supply tube 9 which connects the ink supply needle 8 and the head HD. The head HD is one kind of a liquid ejecting head, and the ink cartridge IC is one kind of a liquid storage section which stores liquid to be ejected. In the head HD, there is provided a successive in-head flow path which reaches from a common ink chamber 31 to the nozzle Nz through an ink replenishment path 32 and a pressure chamber 33. The ink from the ink supply tube 9 is once stored in the common ink chamber 31, and then, replenished from the ink replenishment path 32 to the pressure chamber 33. The common ink chamber 31 is one kind of a common liquid chamber which once stores the ink (liquid) from the ink cartridge IC. Further, the ink replenishment path 32 is an ink flow path for replenishing the ink of the common ink chamber 31 to the pressure chamber 33 and is one kind of a liquid replenishment section. The pressure chamber 33 is provided for every nozzle Nz. A portion of the pressure chamber 33 is partitioned by an elastic plate, and pressure change is provided to the ink in the pressure chamber 33 by deforming the elastic plate by a piezo element 34 (corresponding to an element which performs an operation for ejecting liquid). By the pressure change of the ink in the pressure chamber 33, an ink droplet can be ejected from the nozzle Nz. Here, the degree of deformation of the piezo element 34 is determined in accordance with voltage of the applied driving signal. Therefore, the magnitude of pressure change which is provided to the ink in the pressure chamber 33 can be determined in accordance with the voltage waveform of the driving signal (waveform of an ejection pulse), and further, the ink droplet amount which is ejected from a corresponding nozzle Nz can be variously determined.

The carriage movement mechanism 20 is for moving the carriage CR in the carriage movement direction. In this multifunction device 1, since the head HD is mounted on the carriage CR, the carriage movement mechanism 20 is one kind of a head movement section which moves the liquid ejecting head in a movement direction. The carriage movement mechanism 20 has a timing belt 21, a carriage motor 22, and a guide shaft 23, as shown in FIG. 2. The timing belt 21 is connected to the carriage CR and also, mounted to pass around a driving pulley 24 and an idler pulley 25. The carriage motor 22 is a driving source which rotates the driving pulley 24. The guide shaft 23 is a member for guiding the carriage CR in the carriage movement direction. In the carriage movement mechanism 20, the carriage CR can be moved in the carriage movement direction by operating the carriage motor 22. Then, by performing dot formation operation (corresponding to the movement ejection operation) which intermittently ejects ink while moving the carriage CR, a dot row arranged in the carriage movement direction is formed on the paper S. The dot row is also called a raster line. By alternately repeating the dot formation operation and the transport operation of the paper S, a plurality of raster lines arranged in the paper feed direction are formed on the paper S, so that the printing of an image is performed.

Figure 5:
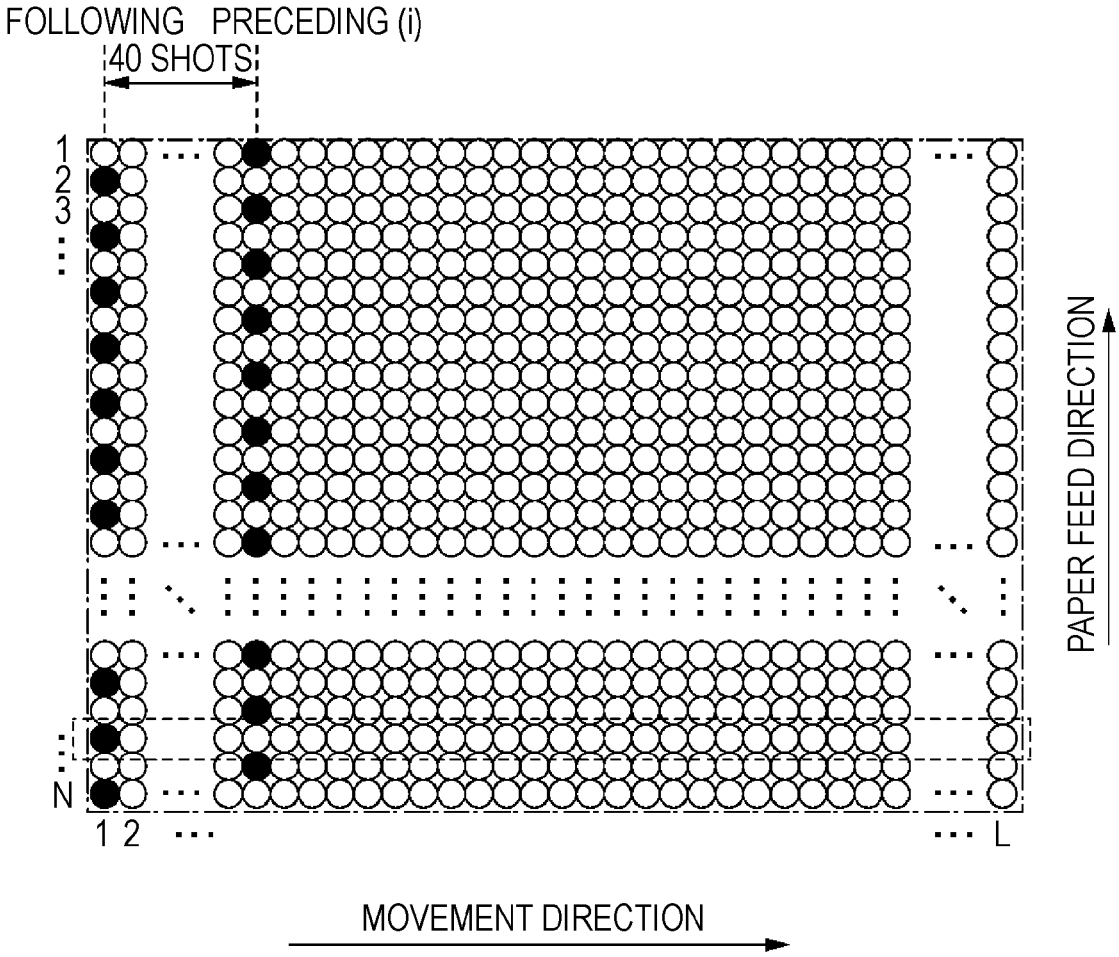
FIG. 5 is a view explaining an aspect in which dots are formed by a nozzle row for a certain color.

The ink ejected from each nozzle Nz lands on the paper S, thereby forming the dots of a nozzle row unit, which are arranged along the nozzle row. As described above, the head HD provided in the multifunction device 1 ejects ink of the same color (kind) from two nozzle rows. In this embodiment, the dots of a nozzle row unit are formed by ink ejected from 360 nozzles Nz. Also, by forming in order these dots with positions being out of alignment in the main scanning direction, a raster line in which a plurality of dots are arranged in the main scanning direction is formed on the surface of the paper S. FIG. 5 is an explanatory view showing an aspect in which the dots of a nozzle row unit are formed by two nozzle rows which eject ink of the same color. In this drawing, a raster region in which dots are formed in a single pass (single main scanning) is schematically expressed by white circles and black circles. That is, a black circle indicates the position of a dot which is formed at the position of each nozzle row shown in FIG. 5, and a white circle indicates a dot which is formed in a case where each nozzle row is at another position. For convenience of explanation, a nozzle row which is precedent in the movement direction of the carriage CR is also called a preceding nozzle row, and a nozzle row which is followed is also called a following nozzle row. A raster line composed of dots arranged in a row in the movement direction is arranged in a plurality of numbers in the paper feed direction, so that the raster region is constituted. As described above, 1 set of nozzle rows have 360 nozzles Nz. Therefore, in single dot formation operation, 360 raster lines corresponding to 360 nozzles Nz are formed in the raster region. In the example of FIG. 5, the raster region has N dots in the paper feed direction and L dots in the movement direction. That is, the raster region has N×L dots in total.

The driving signal generation section 4 is a section which generates a driving signal that is used when ejecting ink from each nozzle Nz. The driving signal generation section 4 generates driving signals of various waveforms on the basis of control signals from a print control unit 68 provided in the main control section 7 (ASCIC 51). The card slot 5 is a portion which performs electrical connection with a memory card. In the memory card which is detachably mounted in the card slot 5, an image file that is a printing object, and so on are stored. The sensor group 6 is composed of a plurality of sensors for detecting the conditions of each section in the multifunction device 1. In the sensor group 6, for example, a linear type encoder 41 for detecting the position of the carriage CR, a rotary type encoder (not shown) for the transport amount of the paper S, and a temperature sensor 42 for detecting the temperature (one kind of an environmental temperature) in the periphery of the head HD are included. Then, a detection signal by each sensor is output to the main control section 7.

The main control section 7 corresponds to a controller which performs control of the multifunction device 1. As shown in FIG. 1A, the main control section 7 has an ASIC (application specific IC) 51, a ROM 52, and a SDRAM (Synchronous DRAM) 53. The ASIC 51 is an integrated circuit with which a CPU or a control circuit, that are required to operate the multifunction device 1, is incorporated. The ROM 52 is a memory which stores various program, data, or the like for controlling the multifunction device 1. The SDRAM 53 functions as a work memory which performs the storing of an image file, or the like. The ASIC 51 is provided with a CPU 61, a host I/F 62, a USB host circuit 63, a decode circuit 64, a card I/F 65, a read control unit 66, an image processing unit 67, a print control unit 68, and a SDRAM I/F 69.

The CPU 61 operates in accordance with a program stored in the ROM 52, thereby generally controlling operation of the multifunction device 1. For example, the CPU 61 controls the read control unit 66, thereby performing the read processing of an image printed on the paper S, or controls the image processing unit 67, thereby performing color conversion processing. Further, the CPU 61 controls the print control unit 68, thereby making the printing mechanism 3 perform image printing processing. The host I/F 62 controls communication between the main control section and the computer CP. For example, it receives print data transmitted from the computer CP, or transmits a status to the computer CP. The USB host circuit 63 performs communication between the main control section and a USB connection type external device HW. The decode circuit 64 performs decode processing for obtaining RGB image data from an image file of JPEG format. Then, the decode circuit 64 controls the SDRAM I/F 69, thereby storing the obtained RGB image data in the SDRAM 53. The card I/F 65 performs communication between the main control section and the memory card mounted in the card slot 5. The read control unit 66 performs control of the image ream mechanism 2. Further, the read control unit 66 controls the SDRAM I/F 69, thereby storing the RGB image data from the image ream mechanism 2 in the SDRAM 53.

The image processing unit 67 converts RGB image data of multi-gradation into CMYK image data of multi-gradation. In addition, the image processing unit 67 converts the CMYK image data into dot formation data for the head HD. Then, it stores the dot formation data obtained by the conversion in the SDRAM 53. The multifunction device 1 can form dots of three sizes, a large dot, a middle-size dot, and a small dot. That is, it controls dot formation with four gradations when dot non-formation is included. In order to express four gradations, the dot formation data is composed of data of 2 bits for every unit region capable of forming dots. That is, it is composed of data [11] representing the formation of a large dot, data [10] representing the formation of a middle-size dot, data [01] representing the formation of a small dot, and data [00] representing the dot non-formation.

The print control unit 68 controls the printing mechanism 3 or the driving signal generation section 4. The print control unit 68 outputs, for example, a motor control signal for controlling a motor. The motor control signal is output to, for example, the transport motor 14 or the carriage motor 22. Further, the print control unit 68 outputs DAC data for determining the voltage of a driving signal which is generated. The DAC data is stored in, for example, the ROM 52, and then, read out and output to the driving signal generation section 4 at the time of the generation of a driving signal. In addition, the print control unit 68 controls the transmission of the dot formation data to the head HD.

Figure 1B:
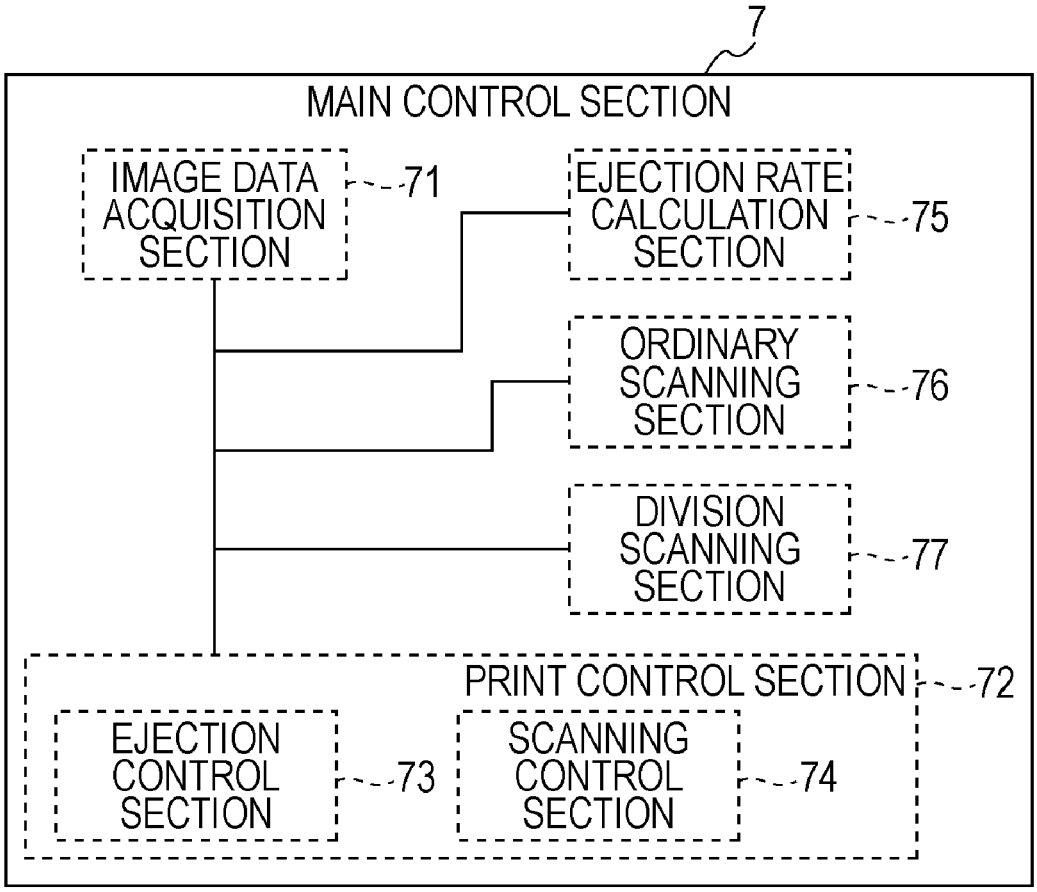
FIG. 1B is a view explaining the respective sections which are realized by a main control section.

The main control section 7 configured as described functions, by the execution of a computer program stored in the ROM 52, as an image data acquisition section 71, a print control section 72 (ejection control section 73 and scanning control section 74), an ejection rate calculation section 75, an ordinary scanning section 76, and a division scanning section 77, as shown in FIG. 1B. On the other hand, operation of the main control section 7 will be described later.

Concerning the Operation of the Multifunction Device 1

Concerning Features of Operation

In the multifunction device 1, there are problems that in cases where the amount of ink which is replenished from the common ink chamber 31 into the pressure chamber 33 is smaller than the amount of ink which is ejected from the nozzle Nz, that is, in a case where the refill rate of ink is slow, poor ejection of ink occurs. This problem is particularly striking in cases where ink is continuously ejected from the nozzle Nz.

In view of such a situation, in this multifunction device 1, by grasping a time series change in the ejection rate from the ink ejection rate in a nozzle row unit for every ejection timing, it is estimated whether or not the replenishment of ink to the pressure chamber 33 will be insufficient. Then, in a case where a decision is made that there is a fear that the replenishment of ink will be insufficient (in the case of satisfying a decision condition representing that an ejection rate of liquid in the movement ejection operation is excessive), the number of times of the dot formation operation related to a given region (a certain range) on the paper S is set to be larger than a case where a decision is made that it is not (a case where the decision condition is not satisfied). Specifically, with respect to a given region on the paper S, on which an image can be printed by dot formation operation of 1 pass, an image is printed by dot formation operation of 2 passes. In short, printing in which the number of nozzles Nz capable of ejecting ink is restricted (the largest ejection amount is restricted) is performed.

Here, the viscosity of ink which is ejected varies in accordance with various factors. For example, it varies in accordance with the kind of ink. The viscosity of ink affects the flow path resistance of a flow path in which the ink flows. That is, the higher the viscosity of ink, the higher the flow path resistance. This can be understood from the fact that flow path resistance $R_{rectangular}$ in the flow path of an approximately rectangular parallelepiped is expressed by the following expression (1), and flow path resistance $R_{circle}$ of a circular cross-section is expressed by the following expression (2).

$$R_{rectangular}=(12\times\text{viscosity }\mu\times\text{length }L)/(\text{width }W\times\text{height }H^3) \quad (1)$$

$$R_{circle}=(8\times\text{viscosity }\mu\times\text{length }L)/(\pi\times\text{radius }r^4) \quad (2)$$

Accordingly, in the case of deciding whether or not to increase the number of times of the dot formation operation related to a certain range, it can be said that it is preferable to consider the viscosity of the ink. In this multifunction device 1, there is also a feature in that, focusing on the fact that the viscosity of ink varies in accordance with the kind of ink, the kind of ink is taken into considered in the above-mentioned decision. Specifically, there is also a feature in that, with respect to a second ink (second liquid) being higher in viscosity than the first ink (first liquid), a decision condition as determined as excess of the ejection rate at a smaller ejection rate than that of the first ink is used. It is explained in detail below.

Concerning the Threshold Value

Prior to an explanation of the printing operation, a threshold value for deciding whether or not to increase the number of times of the dot formation operation related to a certain range is explained. The threshold value is used as a criterion for decisions in the continuity evaluation process (S13, FIG. 7) and replenishment property evaluation process (S15, FIG. 7) in the printing operation and acquired for every kind of ink in the manufacturing process of the multifunction device 1. The acquired threshold value is stored in advance in the SDRAM 53 or the ROM 52 of the main control section 7 in a shipment step of the multifunction device 1.

Although the details will be described later, continuity evaluation process is the process of evaluating whether or not there is continuity in time series change in the ink ejection rate. That is, it is the process of deciding whether or not, in the dot formation operation of a pass which becomes an evaluation object (corresponding to a range of a certain time series), an ink ejection operation being equal to or more than the ejection rate which is prescribed by the threshold value (Th1, equivalent to a first ejection rate) is continuously performed over the number of times which is prescribed by another threshold value (Pc, equivalent to a decision value corresponding to the prescribed number of times).

Further, replenishment property evaluation process is the process of deciding the existence or nonexistence of replenishment property (whether or not sufficient ink can be replenished to the pressure chamber 33). That is, it is the process of deciding, in a case where a decision that continuity exists was made in the above-described continuity evaluation process, whether or not the ink ejection operation being equal to or greater than an ejection rate which is prescribed by the threshold value (Th3, equivalent to a second ejection rate) is performed in a subsequent given movement range (R1, corresponding to another time series). In a case where the ink ejection operation is performed within a given movement range (in a case where a decision condition is satisfied), it is evaluated as having no replenishment property, and then, the number of times of the dot formation operation related to a certain range is increased (the number of nozzles Nz capable of ejecting ink is restricted).

Figures 6A, 6B, 6C:
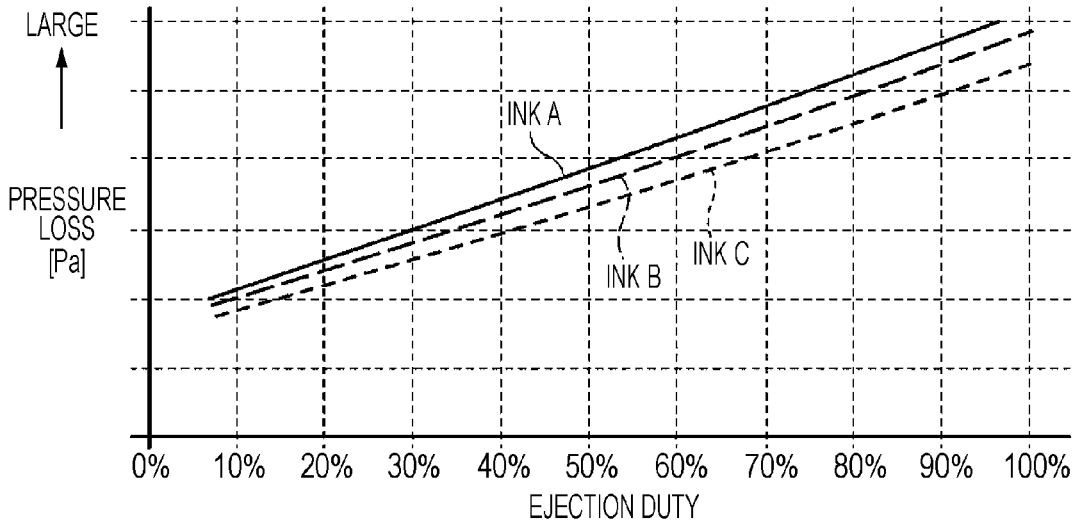
FIG. 6A is a graph showing the relationship between ejection duty and pressure loss for every kind of ink.
FIG. 6B is a view explaining each threshold value which is used in the continuity evaluation process.
FIG. 6C is a view explaining each threshold value which is used in replenishment property evaluation process.

FIG. 6A is a graph showing the relationship between ejection duty and pressure loss for every kind of ink. Here, ejection duty is a proportion of the amount of ink which is ejected at certain timing to the largest amount of ink which can be ejected, and is also called an ejection rate. For example, a nozzle row which ejects ink of a certain color is considered. In this case, the largest amount of ink which can be ejected corresponds to a case where an ink droplet required to form a large dot is ejected from all nozzles Nz which can eject ink of the color. Further, 100% ejection duty means a case where an ink droplet for the formation of a large dot is ejected from all nozzles Nz, and 0% ejection duty means a case where an ink droplet is not ejected from all nozzles Nz.

In addition, in this embodiment, in order to seek out the ejection duty by computing, the amount of an ink droplet is defined as numerical data. Specifically, a data value of a large dot is defined as [4]; a data value of a middle-size dot, [2]; a data value of a small dot, [1]; and a data value of non-ejection, [0]. In other words, the ratio of the amounts of ink droplets in a large dot, a middle-size dot, a small dot, and non-ejection is set as 4:2:1:0. Accordingly, in a case where ink for the formation of a middle-size dot is ejected from all nozzles Nz, the ejection duty amounts to 50%, and in a case where ink for the formation of a small dot is ejected from all nozzles Nz, the ejection duty amounts to 25%.

Pressure loss represents loss of pressure which is generated by the flowing of ink between the ink cartridge IC and the pressure chamber 33, and represents the replenishment property of ink to the pressure chamber 33. That is, large pressure loss means that the amount of ink which flows in the ink replenishment path 32 is smaller than the amount of ink which is ejected from the nozzle Nz. Accordingly, it can be said that as the pressure loss is large, poor ejection due to lack of ink in the pressure chamber 33 easily occurs.

As shown in FIG. 6A, in this embodiment, with respect to three kinds of ink which are different in viscosity, the relationship between pressure loss and ejection duty is acquired. In this example, ink C having lowest viscosity is shown by a dotted line, and ink A having highest viscosity is shown by a solid line. Further, ink B having intermediate viscosity is shown by a broken line. As shown in FIG. 6B, with respect to the ink, comparing viscosities with the ink A as a reference, the ink B has a viscosity which is 5% lower than the ink A, and the ink C has a viscosity which is 13% lower than the ink A.

In the continuity evaluation process, as an indicator of evaluation, an evaluation value C (refers to FIG. 7, etc.) is used. The evaluation value C is incremented (+1) in a case where ejection duty D1 in single dot formation operation is equal to or more than an upper side threshold value Th1 (the first ejection rate), and decremented (−1) in a case where the ejection duty D1 is equal to or less than a lower side threshold value Th2 (a third ejection rate). Then, in a case where the evaluation value C exceeded another threshold value (Pc), a decision is made that continuity exists. In this embodiment, as shown in FIG. 6B, the upper side threshold value Th1 which is used in the continuity evaluation process is varied in accordance with the kind of ink. Specifically, the upper side threshold value Th1 for the ink A is set as 50%, the upper side threshold value Th1 for the ink B is set as 55%, and the upper side threshold value Th1 for the ink C is set as 65%. Similarly, the lower side threshold value Th2 is also varied in accordance with the kind of ink. Specifically, the lower side threshold value Th2 for the ink A is set as 25%, the lower side threshold value Th2 for the ink B is set as 27%, and the lower side threshold value Th2 for the ink C is set as 33%. In addition, the threshold value Pc for the evaluation value C is set as a constant value [8] regardless of the kind of ink.

Accordingly, in the continuity evaluation process, in a case where the ink B was compared with the ink A being higher in viscosity than the ink B, it can be said that the evaluation value C of the ink A is likely to become higher. That is, it is likely to be evaluated as continuity existing. Also, in a case where the ink C was compared with the ink B being higher in viscosity than the ink C, the evaluation value C of the ink B is likely to become higher. Similarly, also in a case where the ink C was compared with the ink A, the evaluation value C of the ink A is likely to become higher.

In the replenishment property evaluation process, with respect to each ink ejection operation of a given movement range R1, if ejection duty D2 is compared with the threshold value Th3 (the second ejection rate) and operation in which the ejection duty D2 is larger than the threshold value Th3 is performed even one time (the prescribed number of times), a decision is made that replenishment property does not exist, and if the ejection duty D2 is equal to or less than the threshold value Th3 at all times, a decision is made that replenishment property exists. In this embodiment, as shown in FIG. 6C, the threshold value Th3 which is used in the replenishment property evaluation process is varied in accordance with the kind of ink. Specifically, with respect to the ink A, the threshold value Th3 is set as 25%, with respect to the ink B, the threshold value Th3 is set as 27%, and with respect to the ink C, the threshold value Th3 is set as 31%. Further, a given movement range R1 is set as a constant value [40] regardless of the kind of ink. That is, an evaluation object is set within a range for 40 dots.

Accordingly, in the replenishment property evaluation process, in a case where the ink B was compared with the ink A, the ink A is likely to be evaluated as having no replenishment property, and in a case where the ink C was compared with the ink B, the ink B is likely to be evaluated as having no replenishment property.

Concerning Printing Operation

Figure 7:
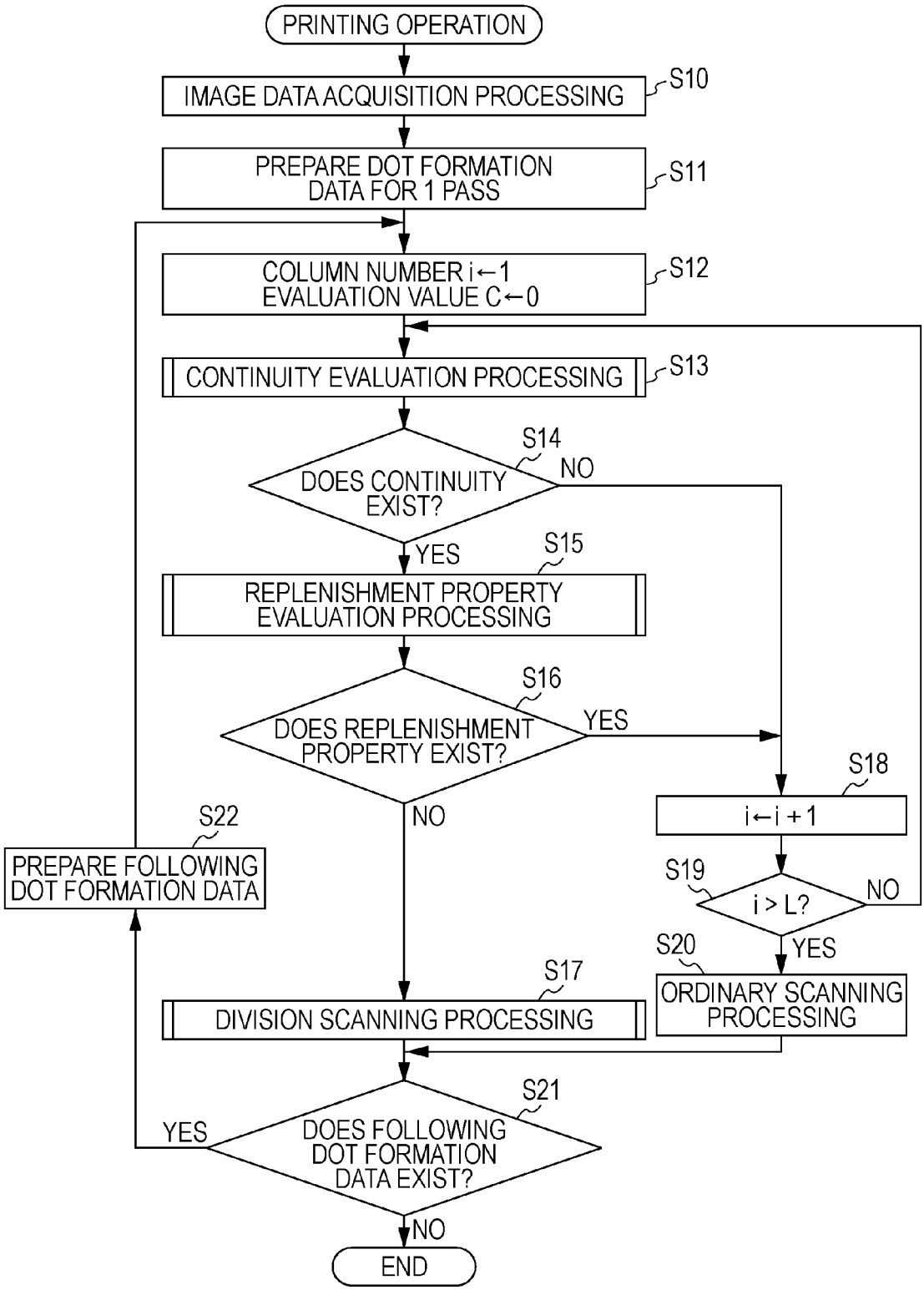
FIG. 7 is a flow chart explaining printing operation.

Printing operation by the multifunction device 1 is explained below. Here, FIG. 7 is a flow chart explaining the printing operation. In this embodiment, in a case where print request from the computer CP has been received, in a case where print request from the external device has been received, or in a case where a print request of image data stored in a memory card connected to the card slot 5 is given from a user of the multifunction device 1, the main control section 7 of the multifunction device 1 controls printing operation. The printing operation is performed by the execution of operation according to a computer program by the CPU 61 of the main control section 7. However, a portion or the whole of operation may also be performed by hardware (electronic circuit).

First, the main control section 7 of the multifunction device 1 acts as the image data acquisition section 71, thereby performing image data acquisition processing (S10). In the image data acquisition process, the main control section 7 acquires image data of JPEG format. For example, image data is acquired from the computer CP, the memory card, or the external device HW. Thereafter, the main control section 7 prepares dot formation data for 1 pass (for single main scanning in ordinary scanning processing) on the basis of the image data acquired in the image data acquisition processing (S11). That is, in the main control section 7, the dot formation data is acquired by converting the acquired image data in the image processing unit 67.

If the dot formation data for 1 pass is acquired, the main control section 7 sets column number i as a value [1] and also, sets the evaluation value C as a value [0] (S12). Here, the column number i indicates a position of a dot in the movement direction, as shown in FIG. 5. For example, the column number i at a scanning starting point is a value [1], and the column number i moved by 1 dot from the starting point becomes a value [2]. As described above, the head HD of this embodiment has two by two a nozzle row which ejects ink of the same color. Therefore, the column number i is determined with a preceding nozzle row in the movement direction as a reference. Further, the evaluation value C is an indicator for evaluating continuity, as described above.

Thereafter, the main control section 7 performs the continuity evaluation process which evaluates whether or not there is continuity in time series change in an ink ejection rate, with respect to the dot formation data for 1 pass (S13). The concrete content of the continuity evaluation process will be explained later.

In a case where in the continuity evaluation process, a decision was made that there is continuity in time series change in an ejection rate (Y in S14), the main control section 7 performs the replenishment property evaluation process (S15). In the replenishment property evaluation process, the main control section 7 decides the existence or nonexistence of replenishment property with respect to the dot formation data for 1 pass. That is, in a case where a decision was made that continuity exists, the main control section 7 decides whether or not sufficient ink can be replenished to the pressure chamber 33 thereafter. The concrete content of the replenishment property evaluation process will also be explained later.

In a case where in the replenishment property evaluation process, a decision was made that replenishment property does not exist (N in S16), the main control section 7 acts as the division scanning section 77, thereby performing division scanning processing (S17). In the division scanning processing, the main control section 7 performs the dot formation operation in plural passes with respect to the dot formation data for 1 pass, which is an evaluation object. Specifically, the dot formation operation is performed by two passes with the number of nozzles Nz used restricted. In this way, a raster region corresponding to the dot formation data which is an evaluation object is printed by two passes. The concrete content of the division scanning processing (S17) will also be explained later.

In addition, in a case where in the continuity evaluation process, a decision was made that continuity does not exist (N in S14), or in a case where in the replenishment property evaluation process, a decision was made that replenishment property exists (Y in S16), the main control section 7 adds [1] to the column number i (S18). Then, on condition that the column number i does not exceed the final column L of the raster region (N in S19), the main control section 7 repeatedly performs the processing from continuity evaluation process (S13). On the other hand, in a case where the column number i exceeds the final row L of the raster region (Y in S19), the main control section 7 acts as the ordinary scanning section 76, thereby performing ordinary scanning processing (S20). In the ordinary scanning processing, the main control section 7 performs the dot formation operation by using the dot formation data for 1 pass, which is an evaluation object, as it is (S20). In this case, the raster region corresponding to the dot formation data which is an evaluation object is printed by single pass.

If the division scanning process (S17) or the ordinary scanning process (S20) is ended, the main control section 7 decides (S21) whether or not there is following dot formation data which has not been evaluated in the continuity evaluation process (S13) or the replenishment property evaluation process (S15). In a case where the following dot formation data exists (Y in S21), the main control section 7 performs a decision in the same way also with respect to the following dot formation data. That is, the main control section 7 prepares the following dot formation data (S22), and then repeatedly performs the processing from S12 with respect to the dot formation data. On the other hand, in a case where following dot formation data does not exist (N in S21), the main control section 7 ends a series of printing operation.

Concerning Continuity Evaluation Processing

Figure 8:
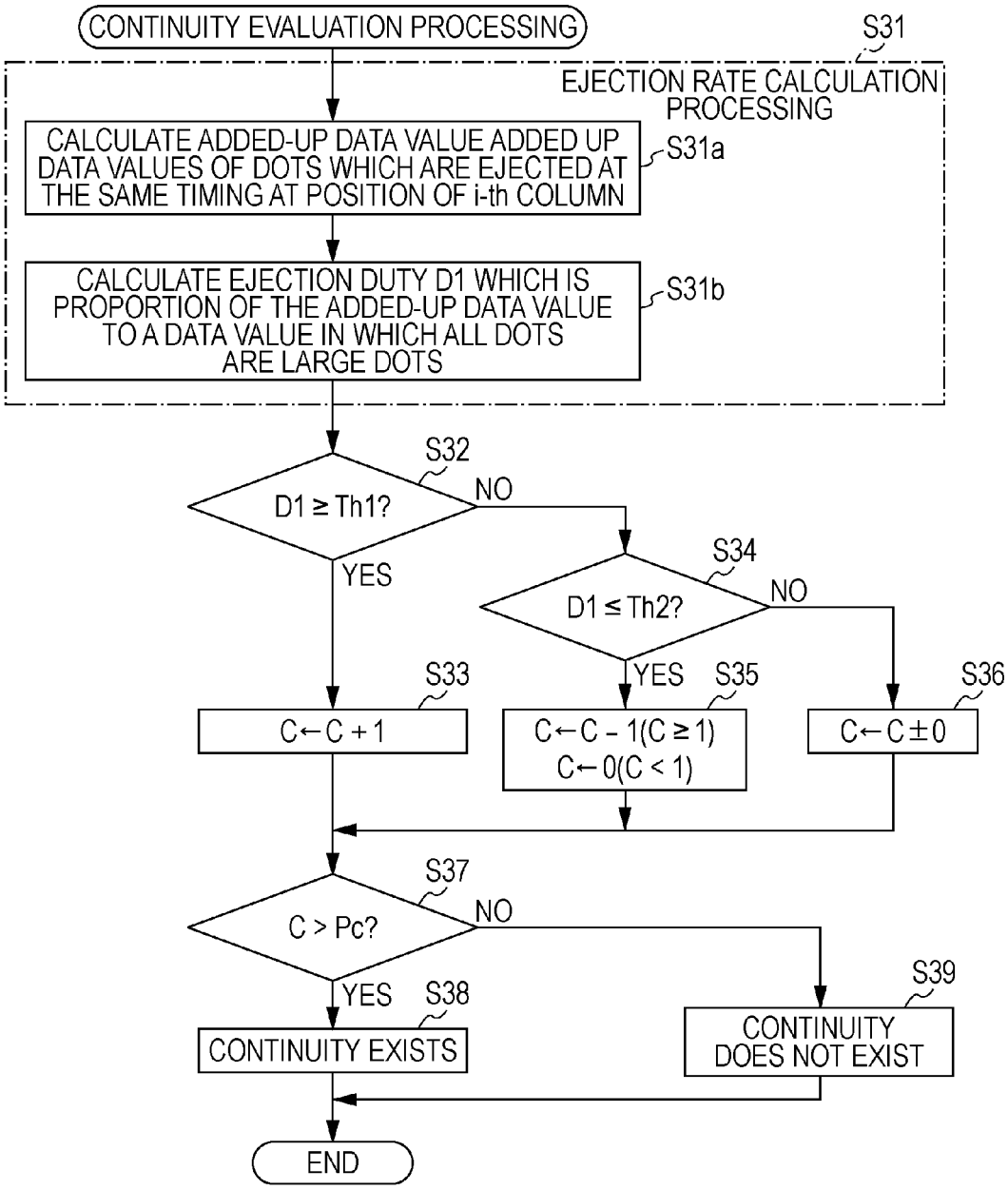
FIG. 8 is a flow chart explaining the continuity evaluation process.

Next, continuity evaluation processing is explained. FIG. 8 is a flow chart explaining the concrete content of the continuity evaluation process (S13).

In the continuity evaluation process, the main control section 7 first acts as the ejection rate calculation section 75, thereby performing ejection rate calculation processing (S31). As described above, the ejection rate is ejection duty (a proportion of the largest amount of ink which can be ejected to the amount of ink which is ejected). Therefore, the main control section 7 calculates added-up data value when a preceding nozzle row is at a position of the column number i (S31*a*). Here, the added-up data value is related to numerical data which represents for every nozzle Nz the amount of an ink droplet that is ejected, and is a value which added up the amounts of ink droplets that are ejected at the same timing. As described above, the data value of a large dot in this embodiment is [4], the data value of a middle-size dot is [2], the data value of a small dot is [1], and the data value of non-ejection is [0]. Therefore, in a case where ink droplets for the formation of a large dot are ejected from 360 nozzles Nz at the same timing, the added-up data value amounts to [1440(=4×360)]. Further, in a case where ink droplets for the formation of a middle-size dot are ejected from 180 nozzles Nz, the added-up data value amounts to [360(=2×180)].

If the added data value has been calculated, the main control section 7 calculates the ejection duty D1 (S31*b*). Here, the largest amount of ink which can be ejected at certain timing with respect to ink of a certain color amounts to [1440] in terms of a data value. Accordingly, the proportion related to [1440] becomes the ejection duty D1. In a case where the added-up data value is [1440] as above, the ejection duty D1 becomes 100%. Further, in a case where the added-up data value is [360], the ejection duty D1 becomes 25%.

If the ejection duty D1 has been calculated, the main control section 7 decides whether or not the calculated ejection duty D1 is equal to or more than the upper side threshold value Th1 (S32). As explained in FIG. 6A, etc., the upper side threshold value Th1 is a reference value for deciding that from the relationship between the ejection duty D1 and the pressure loss, the ejection amount becomes excessive, so that replenishment to the pressure chamber 33 is insufficient. In addition, since the viscosity of ink is determined in accordance with the kind of ink, the main control section 7 acquires the upper side threshold value Th1 corresponding to the kind of ink from the SDRAM 53. For example, with respect to black ink corresponding to the ink A, as the upper side threshold value Th1, 50% is acquired. Also, with respect to color ink corresponding to the ink B, as the upper side threshold value Th1, 55% is acquired. In this way, control can be performed which corresponds to the degree of replenishment of ink to the pressure chamber 33, which varies in accordance with the kind of ink. That is, with respect to ink with a high viscosity, the replenishment of ink to the pressure chamber 33 tends to be insufficient compared to ink having a low viscosity. However, in this multifunction device 1, operation can be transferred to the division scanning processing (S17) such that the replenishment of ink to the pressure chamber 33 is not insufficient even if it is ink with a high viscosity. Then, in a case where the ejection duty D1 is equal to or more than the upper side threshold value Th1 (Y in S32), the main control section 7 adds 1 to the evaluation value C.

On the other hand, in a case where the ejection duty D1 is smaller than the upper side threshold value Th1 (N in S32), the main control section 7 decides whether or not the ejection duty D1 is equal to or less than the lower side threshold value Th2 (S34). The lower side threshold value Th2 is a reference value for deciding that from the relationship between the ejection duty and the pressure loss, the replenishment property of ink to the pressure chamber 33 is sufficiently high, so that ink being equal to or more than the ejection amount can be replenished to the pressure chamber 33. Here too, the main control section 7 acquires the lower side threshold value Th2 corresponding to the kind of ink from the SDRAM 53. For example, with respect to black ink corresponding to the ink A, as the lower side threshold value Th2, 25% is acquired. Also, with respect to color ink corresponding to the ink B, as the lower side threshold value Th2, 27% is acquired. In this way, similarly to the upper side threshold value Th1, control can be performed which corresponds to the degree of replenishment of ink to the pressure chamber 33, which varies in accordance with the kind of ink. Then, in a case where the ejection duty D1 is equal to or less than the lower side threshold value Th2 (Y in S34), the main control section 7 subtracts 1 from the evaluation value C (S35). In addition, in a case where the evaluation value C is smaller than [1], the evaluation value C is set as [0]. Thus, transition to the division scanning processing is delayed. On the other hand, in a case where the ejection duty D1 is larger than the threshold value Th2 (N in S34), that is, in a case where the ejection duty D1 is smaller than the upper side threshold value Th1 and larger than the lower side threshold value Th2, the main control section 7 remains the evaluation value C as it is (S36).

If the evaluation value C has been determined in accordance with the ejection duty D1, the main control section 7 decides whether or not the evaluation value C is larger than the decision value Pc of continuity (S37). As explained in FIG. 6B, the decision value Pc in this multifunction device 1 is set to be [8]. However, the decision value Pc is appropriately set in accordance with the specifications of the multifunction device 1, for example, the structure of the ink storage section of the ink cartridge IC, the structure of the common ink chamber 31, the pressure chamber 33, or the like, and the characteristics of ink.

Then, in a case where the evaluation value C exceeded the decision value Pc of continuity (Y in S37), the main control section 7 decides that there is continuity in time series change in an ejection rate (S38). On the other hand, in a case where the evaluation value C is equal to or less than the decision value Pc (N in S37), the main control section 7 decides that there is no continuity in time series change in an ejection rate (S39).

Concerning Replenishment Property Evaluation Processing

Figure 9:
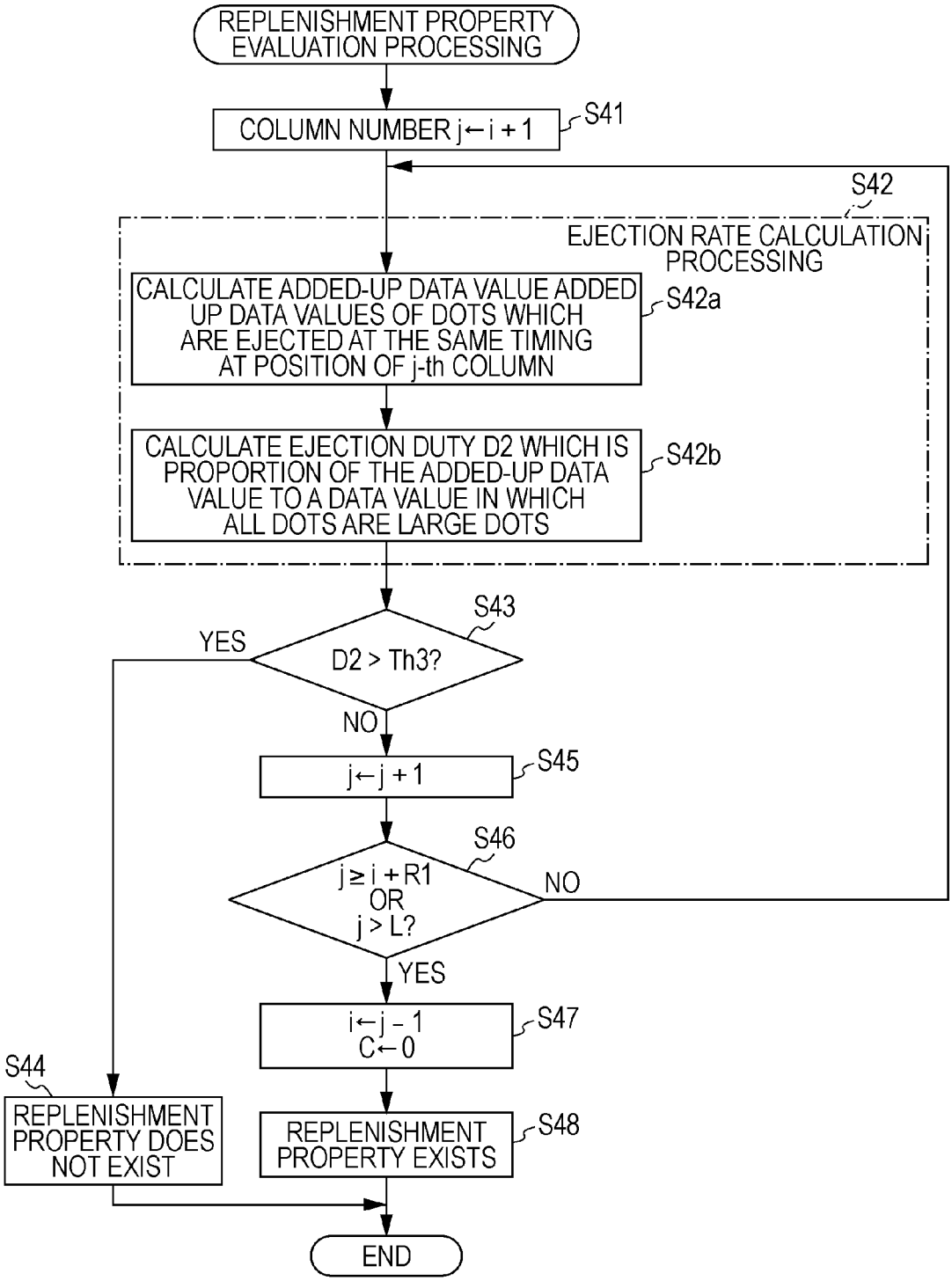
FIG. 9 is a flow chart explaining the replenishment property evaluation process.

Next, replenishment property evaluation processing is explained. FIG. 9 is a flow chart explaining the concrete content of the replenishment property evaluation process (S15).

In the replenishment property evaluation process, the main control section 7 first sets column number j which is used in the replenishment property evaluation process. The column number j is set as a value added 1 to the previous column number i (S41). That is, a column region which is located in the vicinity of the column number, in which a decision was made that continuity exists, in the movement direction of the head HD is set as an object of evaluation. If the column number j has been set, the main control section 7 acts as the ejection rate calculation section 75, thereby performing the ejection rate calculation processing (S42). In the ejection rate calculation processing, the main control section 7 calculates added-up data value when a preceding nozzle row is at a position of the column number j (S42*a*) and calculates the ejection duty D2 (S42*b*). In addition, since the calculation of the added-up data value and the calculation of the ejection duty D2 are the same as the ejection rate calculation processing (S31) in the continuity evaluation process, explanation is omitted.

If the ejection duty D2 has been calculated, the main control section 7 decides whether or not the ejection duty D2 is larger than the threshold value Th3 (S43). Here too, since the viscosity of ink varies in accordance with the kind of ink, the main control section 7 acquires the acquired threshold value Th3 according to the kind of ink from the SDRAM 53. In this way, similarly to the upper side threshold value Th1 or the lower side threshold value Th2, control can be performed which corresponds to the degree of replenishment of ink to the pressure chamber 33, which varies according to the kind of ink. Then, in a case where the ejection duty D2 is larger than the threshold value Th3 (Y in S43), the main control section 7 decides that replenishment property does not exist (S44). That is, a decision is made that a possibility that the amount of ink which is replenished to the pressure chamber 33 will be insufficient is high in the dot formation operation which is performed posterior to the column region for which a decision was made that continuity exists.

In a case where the ejection duty D2 is equal to or less than the threshold value Th3 (N in S43), the main control section 7 adds 1 to the column number j (S45). That is, adjacent column number j is set as an object of evaluation. If 1 has been added to the column number j, the main control section 7 decides whether or not the updated column number j exceeds a given movement range R1 (S46). That is, the main control section 7 compares a value added a given movement range R1 to the above-mentioned column number i with the column number j. Then, in a case where the column number j is smaller than the added value, the main control section 7 decides that the evaluation related to a given movement range R1 is not yet ended, and repeatedly performs the processing from the ejection rate calculation processing (S42). As described above, in this multifunction device 1, a given movement range R1 is set as [40]. Therefore, evaluation is performed with respect to a range for 40 dots in the movement direction.

On the other hand, in a case where the updated column number j is equal to or more than a value added a given movement range R1 to the column number i, or is larger than the final column number L (Y in S46), the main control section 7 sets a value subtracted 1 from the column number j as a new column number i. Also, the evaluation value C is set as [0] (S47). Then, a decision is made that replenishment property exists (S48). That is, a decision is made that ink is sufficiently replenished to the pressure chamber 33 in the dot formation operation which is performed posterior to the column region for which a decision was made that continuity exists.

Concerning Division Scanning Processing

Figure 10:
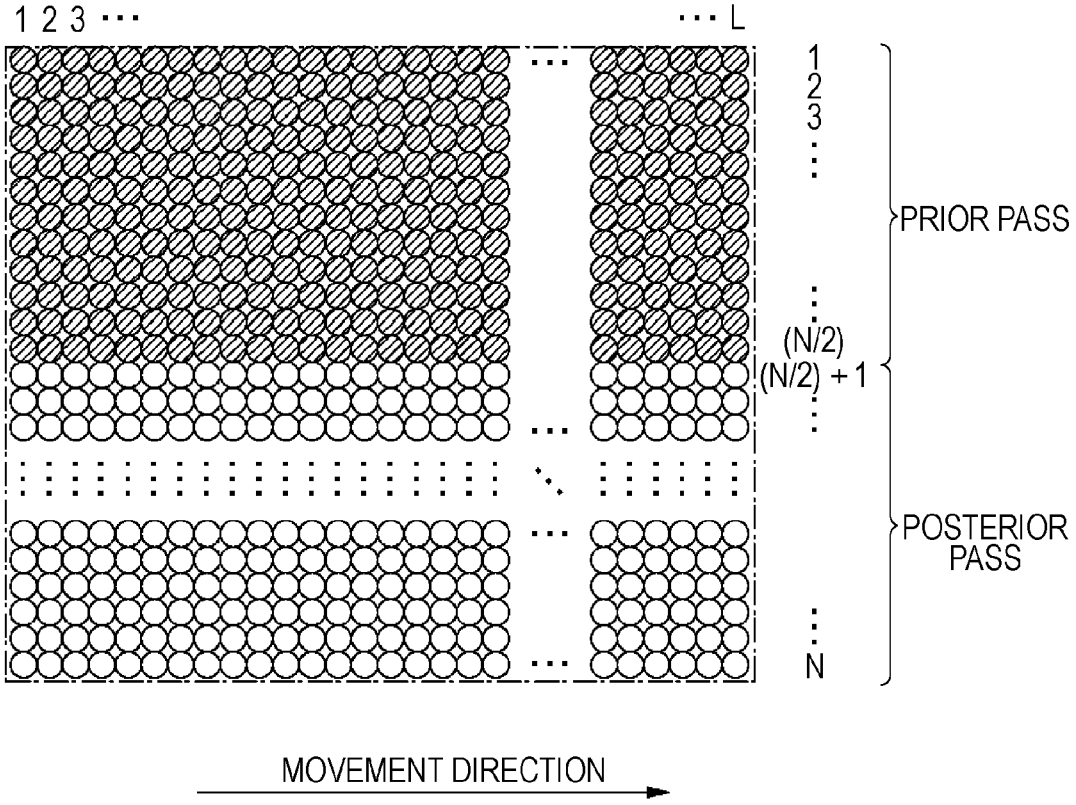
FIG. 10 is a view explaining one example of division scanning processing.

Next, division scanning processing is explained. FIG. 10 is a view explaining one example of the division scanning process (S17). In this drawing, a raster region in the case of printing the dot formation data for 1 pass by 2 passes is schematically expressed by hatched circles and white circles. Here, the hatched circles show dots which are formed in a prior pass, and the white circles show dots which are formed in a posterior pass. In this example, a range defined by N rows×L columns dots corresponds to a certain range which can be printed in 1 pass. Further, in a prior pass, the respective nozzles Nz belonging to one side half portion of the nozzle row are used, whereby raster lines by dots from a 1st row to a (N/2)-th row are formed. Then, in a posterior pass, the remaining nozzles Nz are used, whereby raster lines of dots from an (N/2+1)-th row to an N-th row are formed. In this multifunction device 1, since ink of one color is printed by 360 nozzles Nz, raster lines from a 1st row to a 180th row are formed in a prior pass, and remaining raster lines, raster lines from a 181st row to a 360th row are formed in a posterior pass. Accordingly, in this example, it is can be said that in a case where a decision was made that there is a fear that the replenishment of ink to the pressure chamber 33 will be insufficient, printing with the number of nozzles Nz capable of ejecting ink restricted to a half is performed.

In this multifunction device 1, whether or not to increase the number of times of the dot formation operation related to a certain range is decided for every kind of ink. Therefore, in the case of ejecting the plural kinds of ink, for example, in the case of printing a color image by ejecting ink from each of the black ink nozzle rows Nk1 and Nk2, the yellow ink nozzle rows Ny1 and Ny2, the cyan ink nozzle rows Nc1 and Nc2, and the magenta ink nozzle rows Nm1 and Nm2, there is a case where with respect to the nozzle row which ejects ink of a certain color, a decision is made to increase the number of times of the dot formation operation, and with respect to the nozzle row which ejects ink of a different color, a decision is made not to increase the number of times of the dot formation operation. In this case, the division scanning process is performed in a form which matches another nozzle row with the nozzle row in which the number of times of the dot formation operation is increased.

In other words, with respect to the head HD having a plurality of nozzle rows (corresponding to a nozzle group which ejects the same kind of liquid), in the case of satisfying a decision condition of the continuity evaluation process, the replenishment property evaluation process, or the like with respect to certain ink which is ejected from a certain nozzle row, even if another ink (a liquid being different in viscosity from a certain liquid) which is ejected from another nozzle row does not satisfy the decision condition, the main control section 7 (controller) determines, with respect to another ink, the number of times of the dot formation operation related to a certain range so as to be the same number of time as that in certain ink.

In this way, trouble, for example, color unevenness (variation of the landing amount or position), due to the fact that the number of times of the dot formation operation varies for every ink color can be effectively prevented.

Conclusion

As explained above, in this multifunction device 1, in accordance with time series change in an ejection rate in the nozzles Nz, the main control section 7 decides whether or not there is a fear that the replenishment of ink to the pressure chamber 33 will be insufficient. Then, in a case where a decision is made that there is fear that the replenishment will be insufficient, the main control section 7 dividedly prints the dot formation data for 1 pass by plural passes (performs division main scanning). Therefore, poor ejection of an ink droplet due to lack of ink in the pressure chamber 33 can be avoided before it happens. In addition, focusing on the fact that the viscosity of ink varies in accordance with the kind of ink, so that the degree of replenishment of ink to the pressure chamber 33 is varied, the main control section 7 changes the respective threshold values Th1, Th2, and Th3 in accordance with the kind of ink. Thus, a condition for changing the number of passes is changed in accordance with the kind of ink, and the changing of the number of passes can be performed in an appropriate condition. In addition, since a raster region is dividedly printed by a nozzle group of an upstream side half in the paper feed direction and a nozzle group of a downstream side half, a difference between the raster region and a raster region which is formed in single head scanning by the ordinary scanning processing (S20) can be reduced, so that image quality can be improved as a whole.

Concerning Other Embodiments

Although the above-described embodiment mainly states the multifunction device 1 as the liquid ejecting apparatus, there is included in the embodiment the disclosure of a liquid ejecting method, a liquid ejecting system, a head driving apparatus, a head driving method, a computer program, a computer-readable recording medium, and so on. In addition, the embodiment is for easy understanding of the invention, not for construing the invention as being limited to it. The invention can be modified or improved without departing from the purpose of the invention, and also it is needless to say that the equivalent thereto is included in the invention. In particular, embodiments which are described below are also to be included in the invention.

Concerning the Kind of Ink

In the above-described embodiment, a case where printing operation is performed by using plural kinds of ink which are different in viscosity has been explained. However, the invention is not to be limited to the configuration. For example, the invention can be similarly applied even to a case where the kind (viscosity) of ink is changed by changing the ink cartridge IC. For example, it is preferable if the respective threshold values Th1, Th2, and Th3 corresponding to the ink C is used in the case of using the ink cartridge IC in which an ink set of a dyestuff series is contained, and the respective threshold values Th1, Th2, and Th3 corresponding to the ink A is used in the case of using the ink cartridge IC in which a ultraviolet curable ink set is contained.

Concerning Division Scanning Processing

Figure 11:
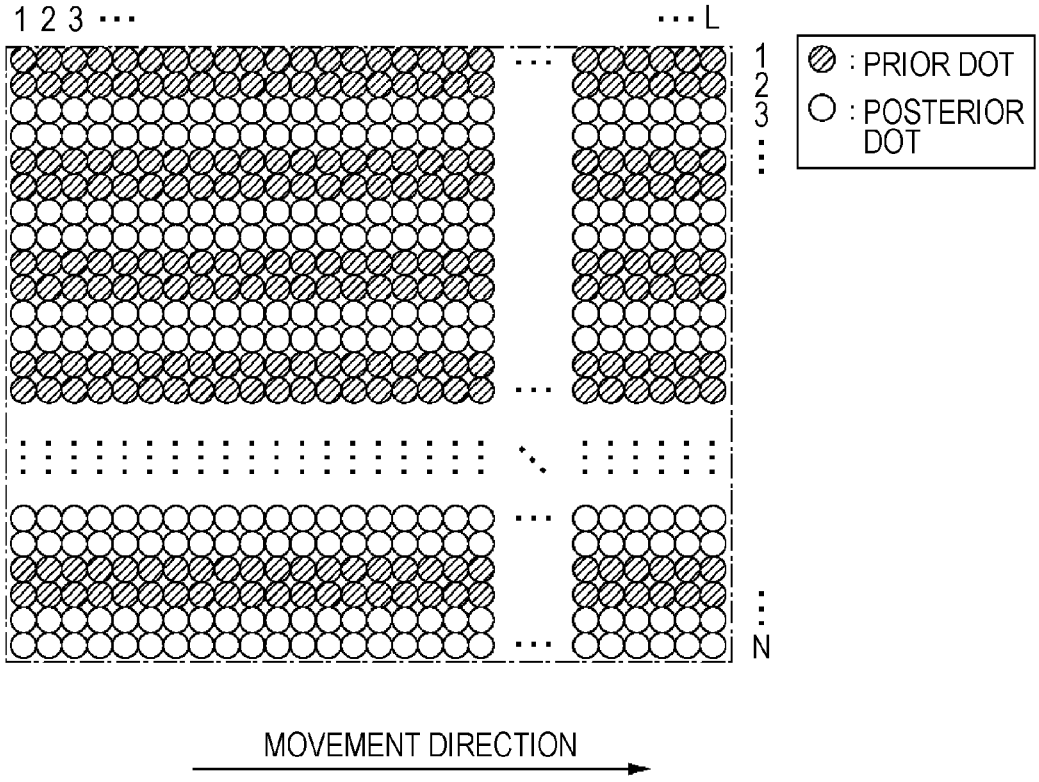
FIG. 11 is a view explaining one example of a first modified example of the division scanning processing.

In the above-described embodiment, in the division scanning processing (S17), the raster lines belonging to the raster region was two-divided in the paper feed direction. However, the invention is not limited to this processing. For example, as shown in FIG. 11, the raster lines which are formed in prior dot formation operation and the raster lines which are formed in posterior dot formation operation may also be alternately formed every two lines, three lines, four lines, or any more.

Figure 12:
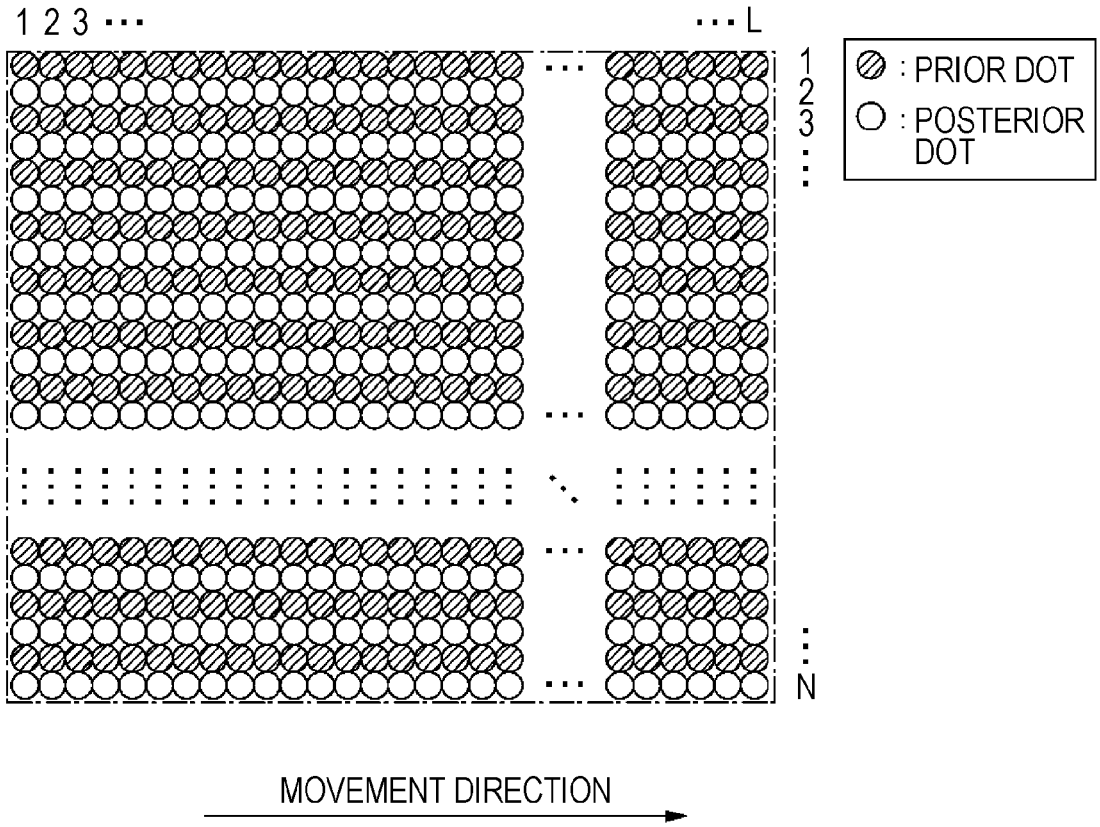
FIG. 12 is a view explaining one example of a second modified example of the division scanning processing.
Figure 13:
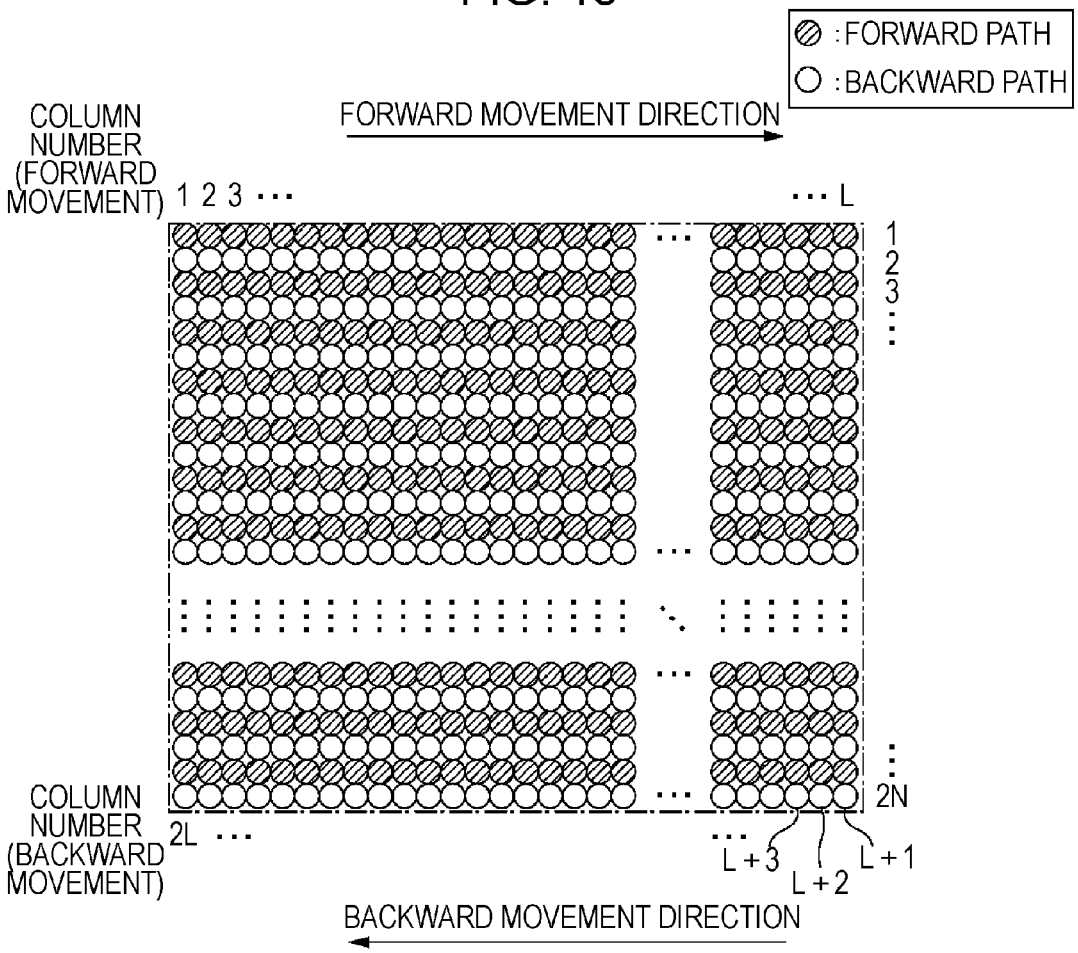
FIG. 13 is a view explaining one example of a third modified example of the division scanning processing.

In addition, as shown in FIG. 12, the raster lines which are formed in prior dot formation operation and the raster lines which are formed in posterior dot formation operation may also be formed alternately (every one line). Further, as shown in FIG. 13, it is also acceptable that the raster lines of hatched circles are formed in forward movement, and the raster lines of white circles are formed in backward movement. In this case, column numbers which are formed in forward movement are given by [1] to [L], column numbers which are formed in successive backward movement are given by [L+1] to [2L], and the largest column number is treated as [2L].

In addition, in a case where one raster line is formed in multiple dot formation operation, the control of the above-described embodiment is applied to single dot formation operation.

Concerning Continuity Evaluation Processing

In the above-described embodiment, the upper side threshold value Th1 or the lower side threshold value Th2, which are used in the continuity evaluation process, is changed in accordance with the kind of ink. However, the invention is not limited to this method. The decision value Pc may also be changed. For example, in the case of the second ink being higher in viscosity than the first ink, it is also acceptable that the decision value Pc is set to be smaller than a value corresponding to the first ink, so that the division evaluation processing is easily performed.

In the same way, an addition value or a subtraction value, which are used in the continuity evaluation process, may also be changed. For example, in the case of the second ink, the absolute value of the addition value is set to be larger than the absolute value of the subtraction value. Even in this case, in the second ink, the division scanning processing is performed more easily than the first ink.

Concerning Environmental Temperature

In the above-described embodiment, an environmental temperature was not particularly considered. Here, in a case where the viscosity of liquid varies in accordance with environmental temperature, environmental temperature may also be considered. For example, in a second temperature being lower in environmental temperature than a first temperature, a decision may also be made that an ejection rate is excessive at an ejection rate being smaller than in the first temperature.

Concerning Liquid Ejecting Apparatus

Liquid that the liquid ejecting apparatus of the invention targets is not to be limited to ink described above, but the invention intends to target various liquid such as metal paste, powder, and liquid crystal. As the representative example of the liquid ejecting apparatus, there is an ink jet type recording apparatus provided with the ink jet type recording head HD for image recording as described above. However, the invention is not limited to the ink jet type recording apparatus, but can also be applied to an image recording apparatus adopted another method, a color material ejecting apparatus which is used in the manufacturing of a color filter of a liquid crystal display or the like, an electrode material ejecting apparatus which is used in the formation of an electrode of an organic EL (Electro Luminescence) display, a field emission display (FED), or the like, a liquid ejecting apparatus which ejects liquid including a living organic material that is used in biochip fabrication, a sample ejecting device as a precision pipette, or the like.

What is claimed is:

1. A liquid ejecting apparatus comprising:

a liquid ejecting head which has a plurality of successive flow paths reaching from a liquid replenishment section to a nozzle and ejects a liquid from the nozzle;

a head movement section which moves the liquid ejecting head in a movement direction; and a controller which controls a movement ejection operation that ejects the liquid from the nozzle while moving the liquid ejecting head in the movement direction, and, in the case of satisfying a decision condition representing that an ejection rate of the liquid in the movement ejection operation is excessive, makes the number of times of the movement ejection operation related to a certain range be larger than a case where the decision condition is not satisfied, wherein, with respect to a second liquid being higher in viscosity than a first liquid, the controller determines the number of times of the movement ejection operation related to the above-mentioned certain range by the above-mentioned decision condition determined as excess of the above-mentioned ejection rate at an ejection rate being smaller than that of the first liquid, wherein the ejection rate of the liquid is a proportion of the amount of liquid which is ejected at a certain timing to the largest amount of liquid which can be ejected at the certain timing.

2. The liquid ejecting apparatus according to claim 1, wherein the controller performs a continuity evaluation in which in a case where ejection of the liquid at an ejection rate being equal to or more than a first ejection rate is performed the prescribed number of times within a range of a certain time series, it is evaluated as continuity existing; and a replenishment property evaluation in which in a case wherein the continuity evaluation has been evaluated as continuity existing, and then, in a case where ejection of the liquid at an ejection rate being equal to or more than a second ejection rate is performed the prescribed number of times within a range of another time series subsequent to the above-mentioned certain time series, it is evaluated as having no replenishment property, whereby, in a case wherein the replenishment property evaluation has been evaluated as having no replenishment property, a decision is made that the decision condition is satisfied.

3. The liquid ejecting apparatus according to claim 2, wherein in the continuity evaluation, in a case where the ejection rate at a certain timing is equal to or more than the first ejection rate, addition of an evaluation value is performed, on the other hand, in a case where the ejection rate at certain timing is equal to or less than a third ejection rate being lower than the first ejection rate, subtraction of an evaluation value is performed, and in a case where the evaluation value exceeds a decision value corresponding to the prescribed number of times, it is evaluated as continuity existing.

4. The liquid ejecting apparatus according to claim 2, wherein the first ejection rate corresponding to the second liquid is smaller than the first ejection rate corresponding to the first liquid, and the second ejection rate corresponding to the second liquid is smaller than the second ejection rate corresponding to the first liquid.

5. The liquid ejecting apparatus according to claim 1, wherein the liquid ejecting head has a nozzle row with a plurality of nozzles arranged in an intersecting direction intersecting with the movement direction, and the controller, in a case where the decision condition is satisfied, performs a prior movement ejection operation by using a portion of the nozzles belonging to the nozzle row and performs a posterior movement ejection operation by using another portion of the nozzles.

6. The liquid ejecting apparatus according to claim 5, wherein the controller performs the prior movement ejection operation by using the respective nozzles which are a portion of the nozzles belonging to the nozzle row and are located at one side half portion in the intersecting direction, and performs the posterior movement ejection operation by using remaining nozzles.

7. The liquid ejecting apparatus according to claim 1, wherein the liquid ejecting head has a certain nozzle group composed of a plurality of nozzles which ejects a certain kind of liquid, and an another nozzle group composed of a plurality of nozzles which ejects another kind of liquid being different in viscosity from the above-mentioned certain kind of liquid, and the controller, in the case of satisfying the decision condition with respect to the above-mentioned certain kind of liquid, even if the above-mentioned another kind of liquid does not satisfy the decision condition, sets, with respect to the above-mentioned another kind of liquid, the number of times of the movement ejection operation related to the above-mentioned certain range to be the same number of times as that of the above-mentioned certain liquid.

8. A liquid ejecting method that, by using a liquid ejecting head which has a plurality of successive flow paths reaching from a liquid replenishment section to a nozzle, replenishes liquid supplied from a liquid storage section and stored in a common liquid chamber, through by the liquid replenishment section and ejects liquid from a corresponding nozzle, the method comprising:

deciding whether or not to satisfy a decision condition representing that an ejection rate of the liquid in a movement ejection operation that ejects liquid from the nozzle while moving the liquid ejecting head in a movement direction is excessive, and also, showing that, with respect to second liquid being higher in viscosity than first liquid, the ejection rate is excessive at an ejection rate being smaller than that in the first liquid; and in a case where the decision condition is satisfied, in the movement ejection operation, making the number of times of the movement ejection operation related to a certain range be larger than a case where the decision condition is not satisfied, wherein the ejection rate of the liquid is a proportion of the amount of liquid which is ejected at a certain timing to the largest amount of liquid which can be ejected at the certain timing.

* * * * *